US006357950B1

(12) United States Patent
Chih

(10) Patent No.: US 6,357,950 B1
(45) Date of Patent: Mar. 19, 2002

(54) CLEANING BRUSH WITH VARIABLE SPRINKLING PATTERN

(76) Inventor: Gordon Chih, No. 33, Tien-Yang Lane, Chao-An Li, Lu-Kang Chen, Changhua Hsien (TW)

( * ) Notice: Subject to any disclaimer, the term of this patent is extended or adjusted under 35 U.S.C. 154(b) by 0 days.

(21) Appl. No.: 09/863,256

(22) Filed: May 24, 2001

(51) Int. Cl.[7] ..... A47L 13/22; A47L 13/10

(52) U.S. Cl. ..... 401/289; 15/50.1; 239/437; 239/562; 401/270; 401/281; 401/287

(58) Field of Search ..... 401/289, 287, 401/286, 270, 280, 281; 15/50.1, 49.1; 239/437, 562

(56) References Cited

U.S. PATENT DOCUMENTS 3,832,069 A * 8/1974 Petsch ..... 401/289
5,452,961 A * 9/1995 Lu ..... 401/281 X

* cited by examiner

*Primary Examiner*—Gregory L. Huson
*Assistant Examiner*—Kathleen J. Prunner
(74) *Attorney, Agent, or Firm*—Troxell Law Office PLLC

(57) ABSTRACT

A cleaning brush with a variable sprinkling pattern, includes a brush seat, a brush cover having brush hairs, a first slide channel disposed on the brush seat, a first base seat disposed in the first slide channel, outer, middle and inner cylindrical bodies and a second slide channel disposed on the first base seat, a slide block, a rotary switch, a second base seat and a press button disposed on the rotary switch, a resilient member disposed between the second base seat and the press button, a tube body and a sprinkling head. The brush seat is formed with several teeth annularly arranged at intervals. The slide block is engaged with the press button. The second base seat is connected with the sprinkling head disposed on the brush seat. The press button drives the slide block to engage with or disengage from the teeth. The second base seat is disposed on the rotary switch for driving the sprinkling head to change the angle contained by the brush seat and the tube body and vary the sprinkling pattern.

8 Claims, 10 Drawing Sheets

XIII

XXI

XII

XX

CLEANING BRUSH WITH VARIABLE SPRINKLING PATTERN

BACKGROUND OF THE INVENTION

The present invention is related to a cleaning brush, and more particularly to a cleaning brush with elongated stem and sprinkling head.

A conventional cleaning brush has a brush head fixedly connected with an elongated stem. When cleaning, the brush head is dipt with a detergent and used to brush a dirty place such as a floor or a wall face. Then, a sprinkling gun is used to sprinkle the dirty place. In an improved cleaning brush, the brush head is formed with an opening connected to a water tube or communicating with the hollow elongated stem. Accordingly, the water can flow out from the brush head to facilitate cleaning operation.

The elongated stem of the cleaning brush has a length of about 1.8~3.6 m for cleaning the wall at a certain height. In the case that the floor or wall face is first brushed and then sprinkled by a sprinkling gun, there are some shortcomings as follows:

1. In general, the sprinkling gun has a short length so that the water pressure at the terminal of the water beam will be reduced and it is hard to clean up the dirt at a high place.
2. The water sprinkled from the sprinkling gun will splash back onto the user.
3. It is necessary to replace the tool and this is inconvenient for the user.

With respect to the cleaning brush with flowing out water, the water only flows out from the brush head and can hardly provide any sprinkling and cleaning effect. Therefore, the user still needs to laboriously brush the dirty place.

Moreover, in the conventional cleaning brush, the brush head is fixedly connected with the stem and thus is unable to effectively clean the corner. An improved cleaning brush has a brush head and a stem containing variable angle for meeting the requirement of different configurations of working sites. The angle controlling switch is disposed at an adjoining section between the brush head and the stem or a lateral side of the brush head. However, the water still only flows out from the brush head without any sprinkling or cleaning effect. Furthermore, the angle controlling switch projects from the adjoining section so that the appearance of the cleaning brush is affected and the freeness of the brush head is also affected.

SUMMARY OF THE INVENTION

It is therefore a primary object of the present invention to provide a cleaning brush with variable sprinkling pattern. The sprinkling head is disposed at the brush head, whereby the cleaning brush has both functions of brushing and sprinkling. In addition, the sprinkling pattern is variable so that the cleaning brush can easily and effectively clean up the dirt.

It is a further object of the present invention to provide the above cleaning brush with variable sprinkling pattern in which the sprinkling head is disposed at the brush head so that it is unnecessary to replace the cleaning tool.

It is still a further object of the present invention to provide the above cleaning brush with variable sprinkling pattern in which the brush hairs surround the sprinkling head, whereby when the sprinkling head is close to the dirty place for sprinkling off the dirt, the injected water beam will not splash back onto the user.

It is still a further object of the present invention to provide the above cleaning brush with variable sprinkling pattern in which the switch for controlling the direction of the brush head and the switch for controlling the sprinkling head are integrally disposed so that the user can conveniently operate the switches.

According to the above objects, the cleaning brush with variable sprinkling pattern of the present invention includes a brush seat, a brush cover having brush hairs, a first slide channel disposed on the brush seat, a first base seat disposed in the first slide channel, an outer, a middle and an inner cylindrical bodies and a second slide channel disposed on the first base seat, a slide block, a rotary switch, a second base seat and a press button disposed on the rotary switch, a resilient member disposed between the second base seat and the press button, a tube body and a sprinkling head.

The present invention can be best understood through the following description and accompanying drawings wherein:

DETAILED DESCRIPTION OF THE PREFERRED EMBODIMENTS

Figure 1:
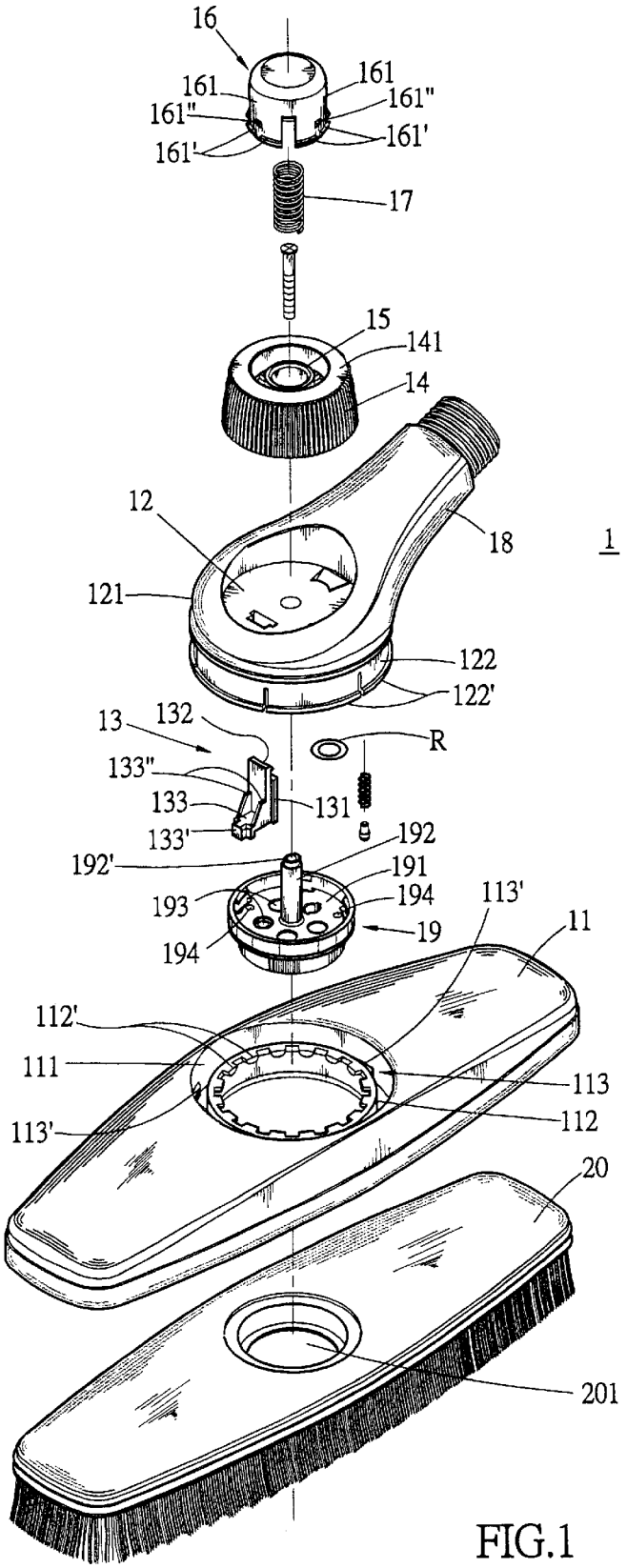
FIG. 1 is a perspective exploded view of a preferred embodiment of the present invention.
Figure 2:
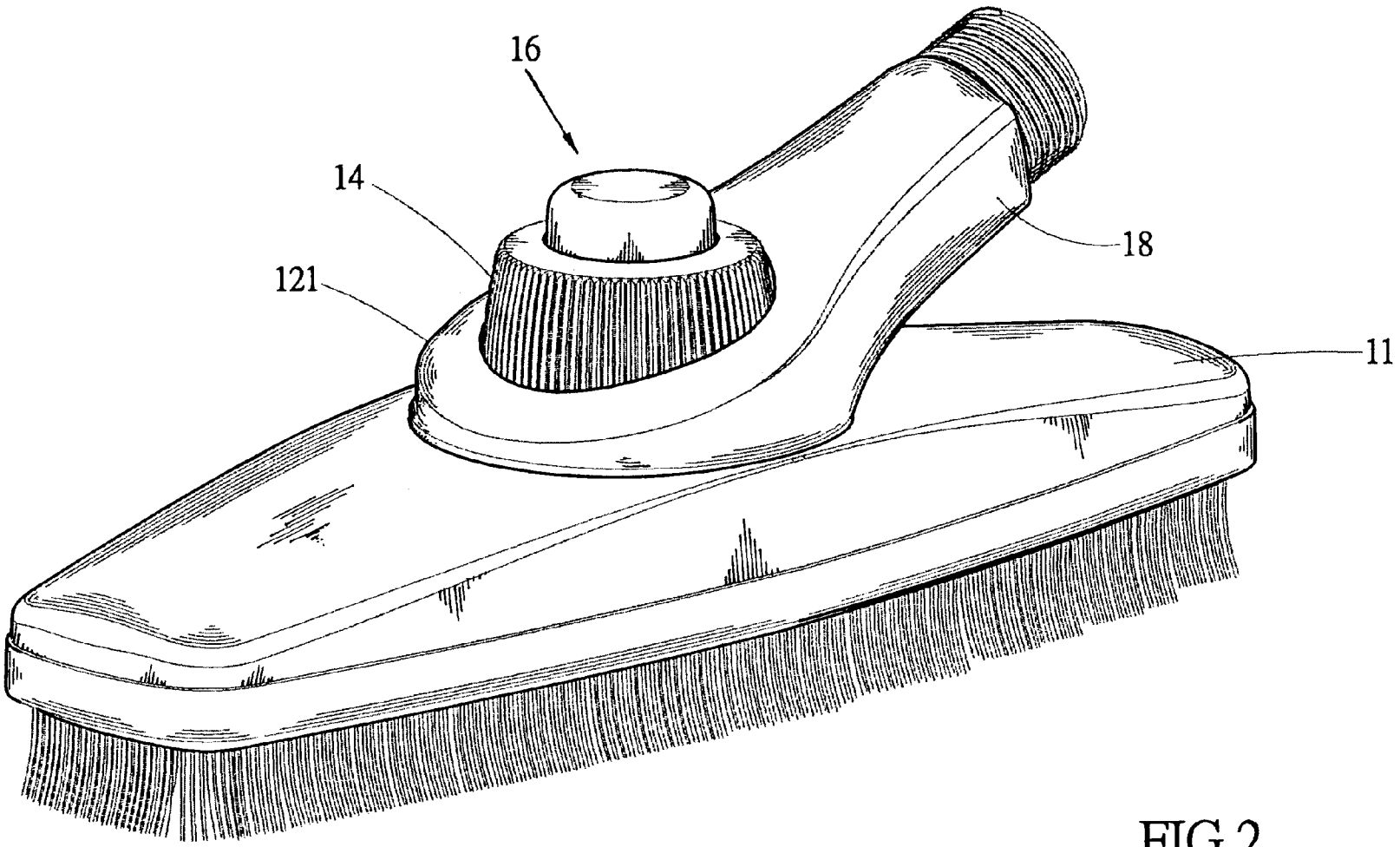
FIG. 2 is a perspective assembled view of the preferred embodiment of the present invention.
Figure 3:
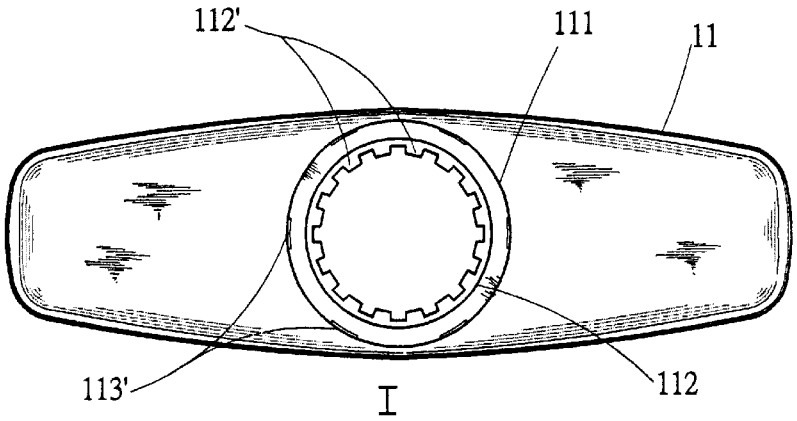
FIGS. 3I, 3II, 3III and 3IV are top, side, bottom and perspective views of the brush seat of the present invention.
Figure 3:
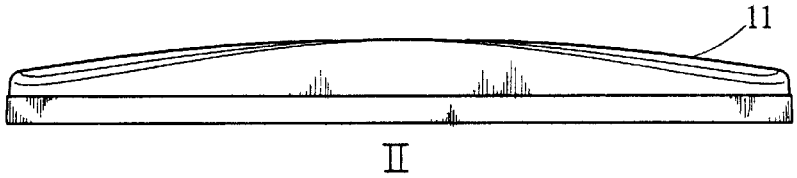
Figure 3:
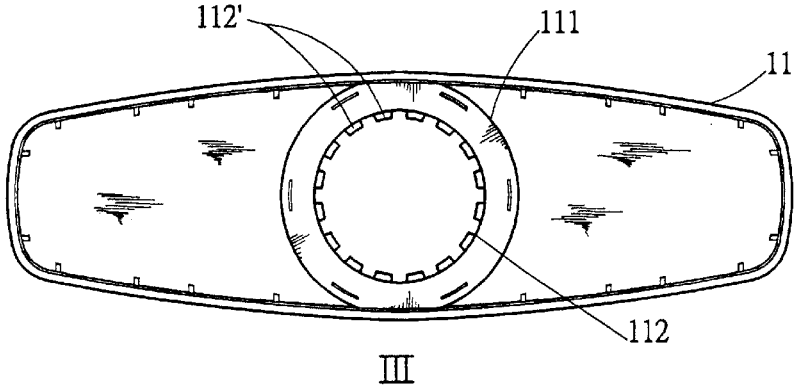
Figure 3:
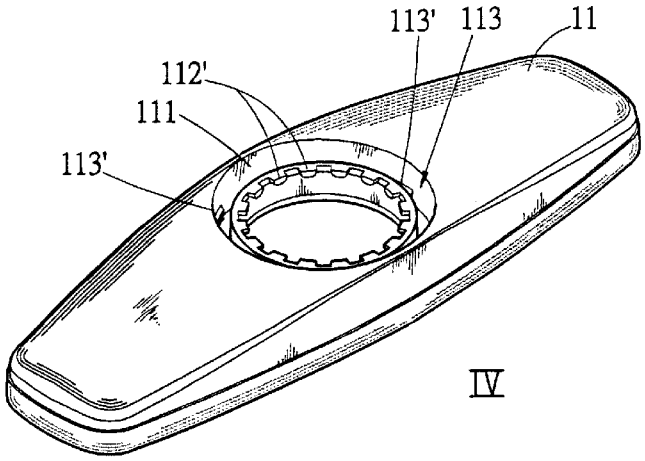
Figure 4:
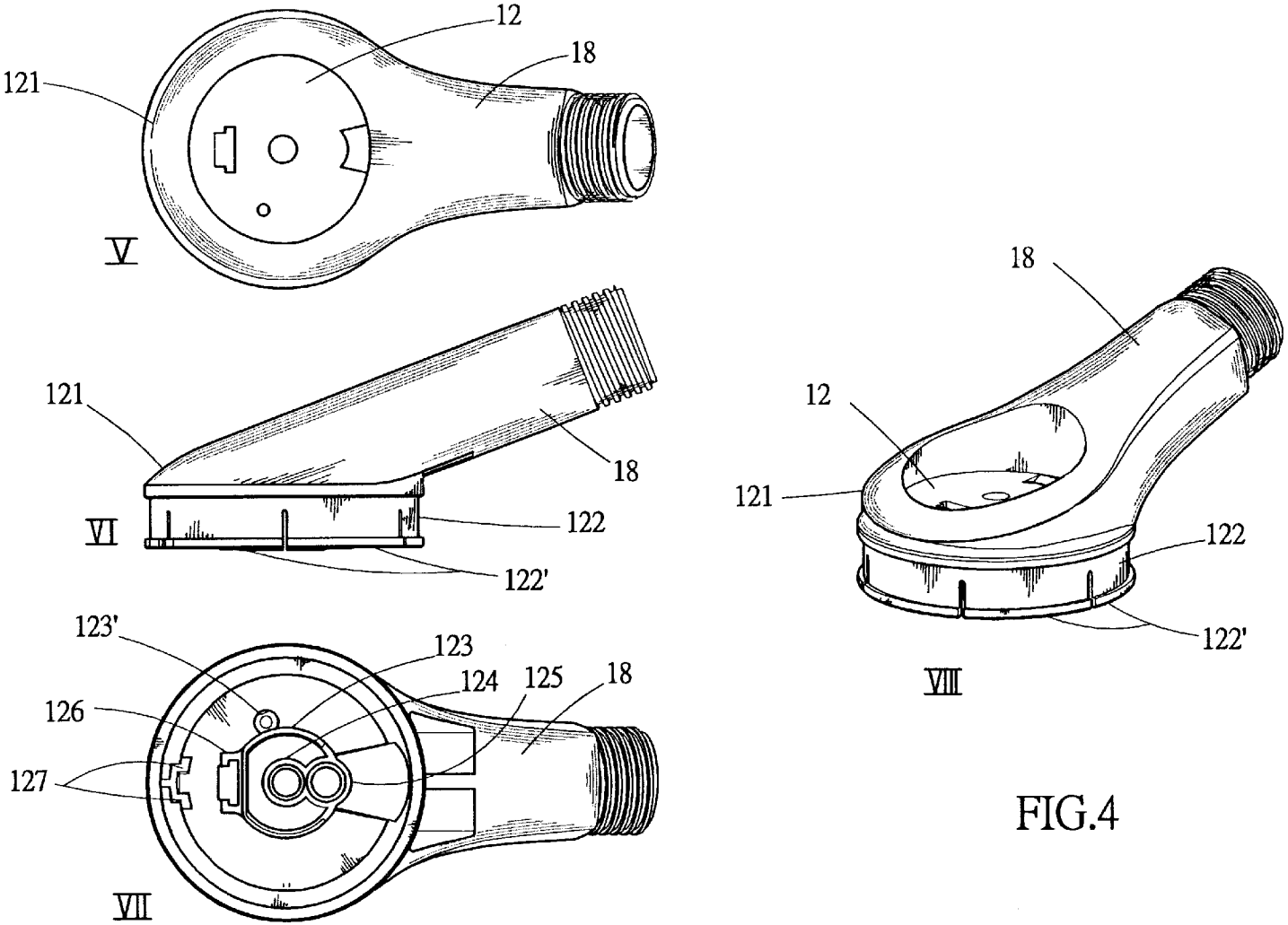
FIGS. 4V, 4VI, 4VII and 4VIII are top, side, bottom and perspective views of the first base seat of the present invention.
Figure 5:
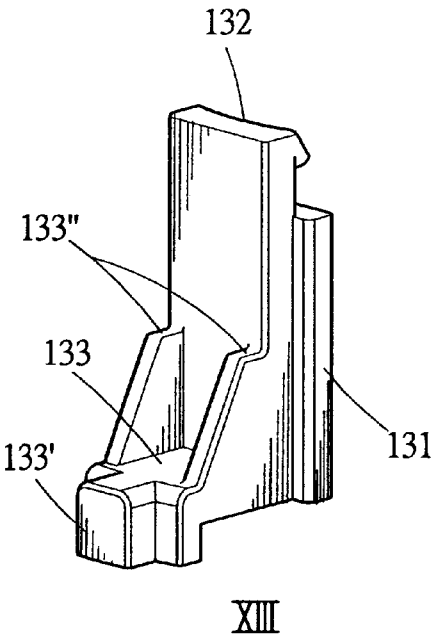
FIGS. 5IX, 5X, 5XI, 5XII and 5XIII are front, side, rear, bottom and perspective views of the slide block of the present invention.
Figure 5:
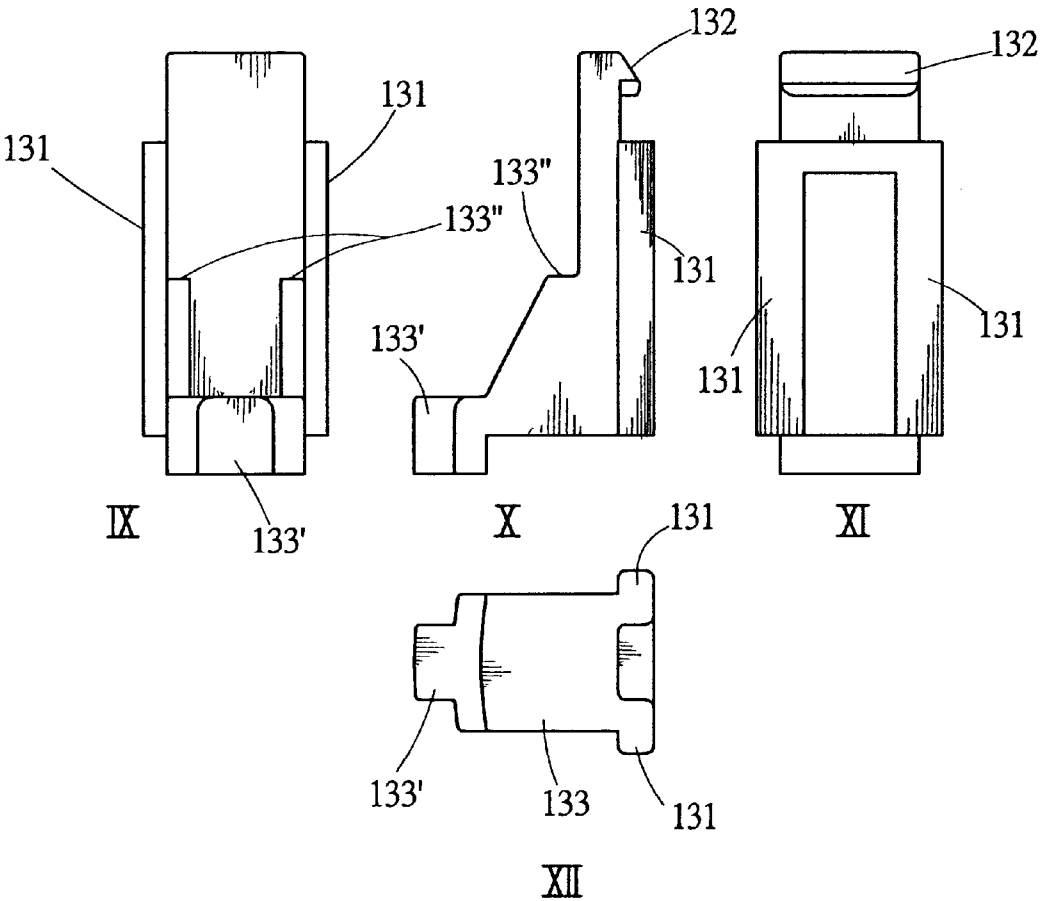
Figure 6:
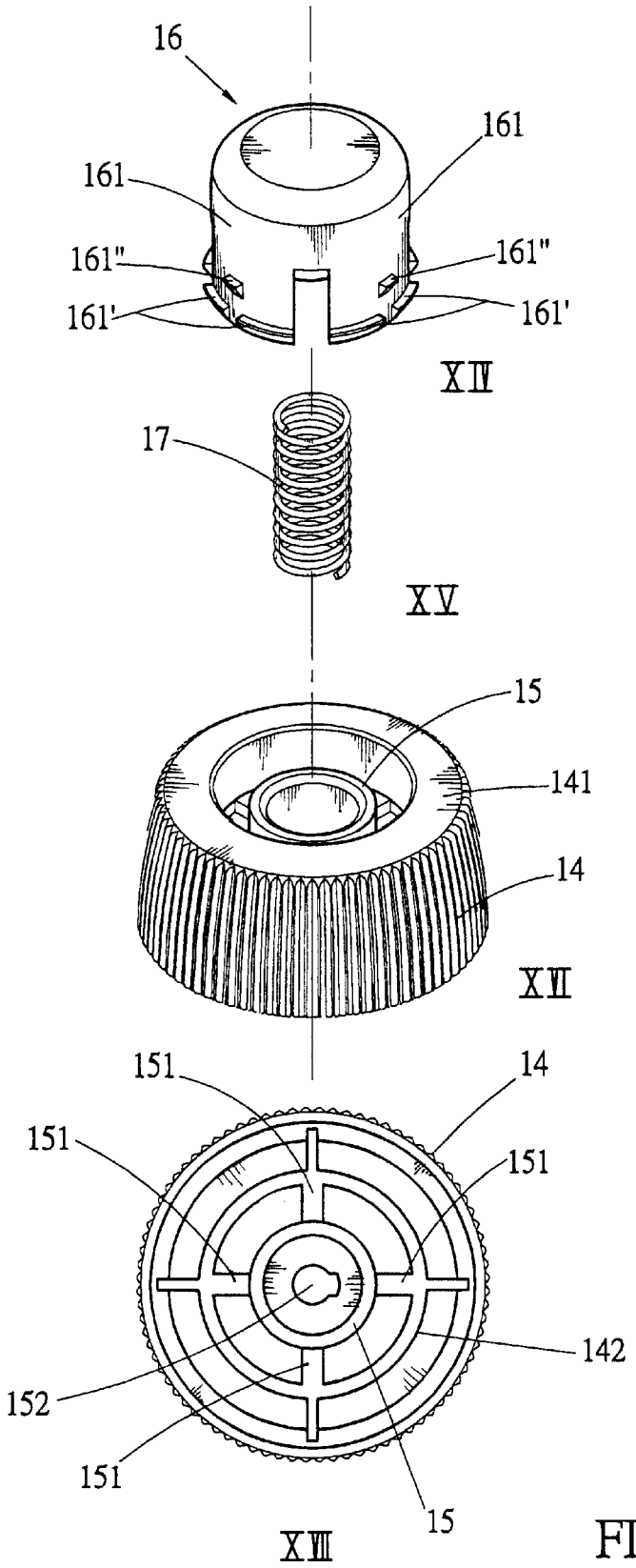
FIGS. 6XIV, 6XV, 6XVI and 6XVII are perspective views of the press button, resilient member and rotary switch and bottom view of the rotary switch of the present invention.
Figure 7:
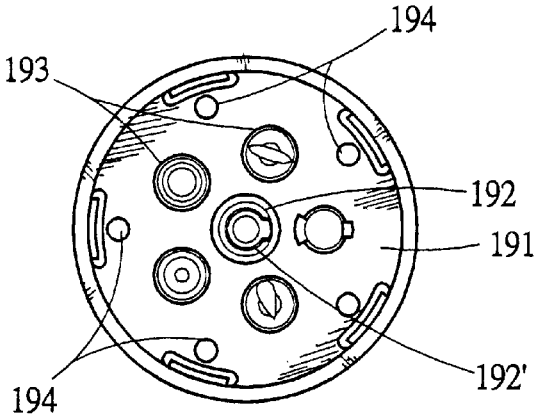
FIGS. 7XVIII, 7XIX, 7XX and 7XXI are top, side, bottom and perspective views of the sprinkling head of the present invention.
Figure 7:
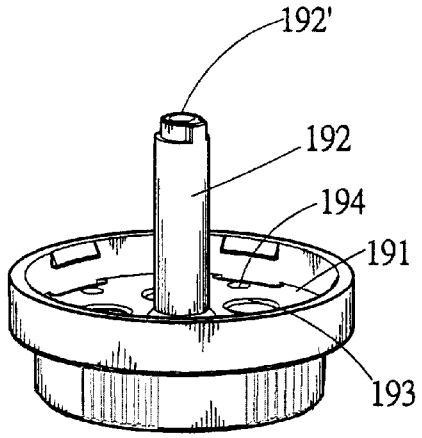
Figure 7:
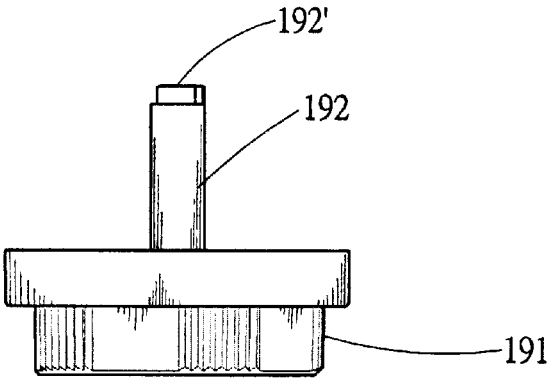
Figure 7:
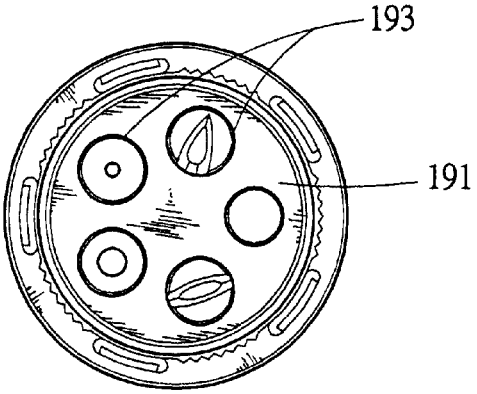
Figure 8:
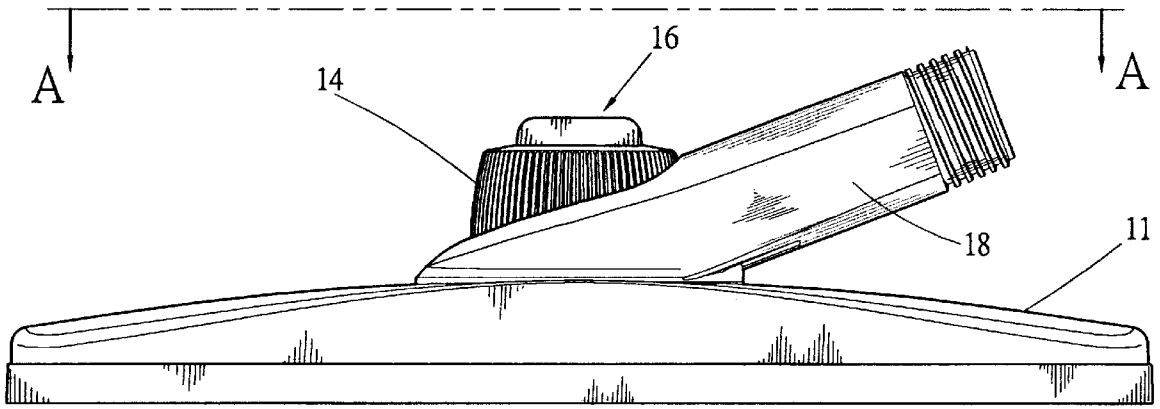
FIG. 8 is a side view of the sprinkling head and the brush cover in a not assembled state.
Figure 9:
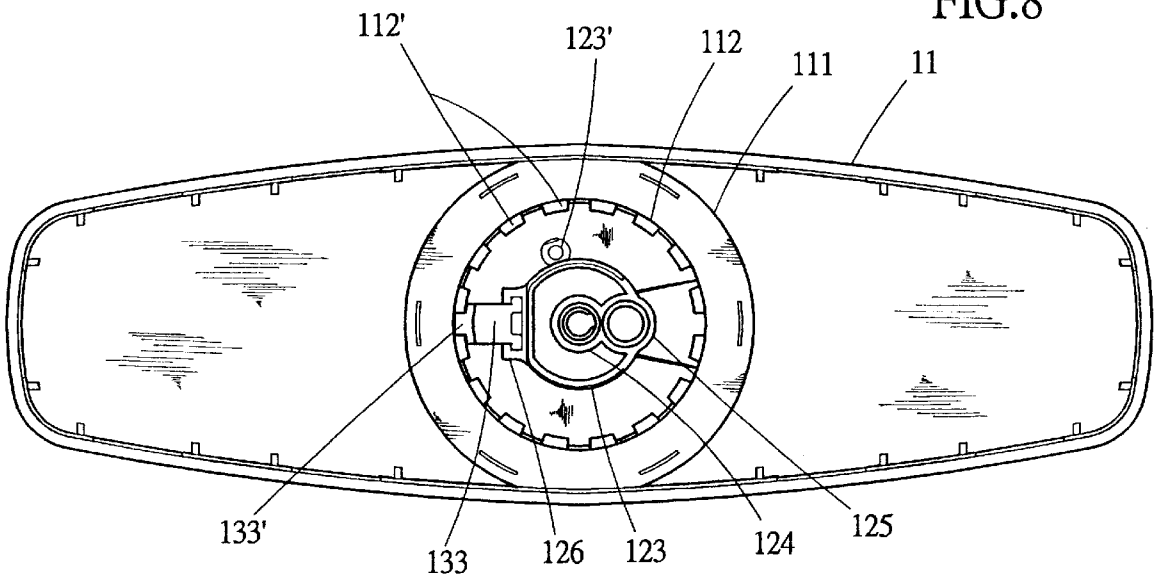
FIG. 9 is a bottom view according to FIG. 8.
Figure 10:
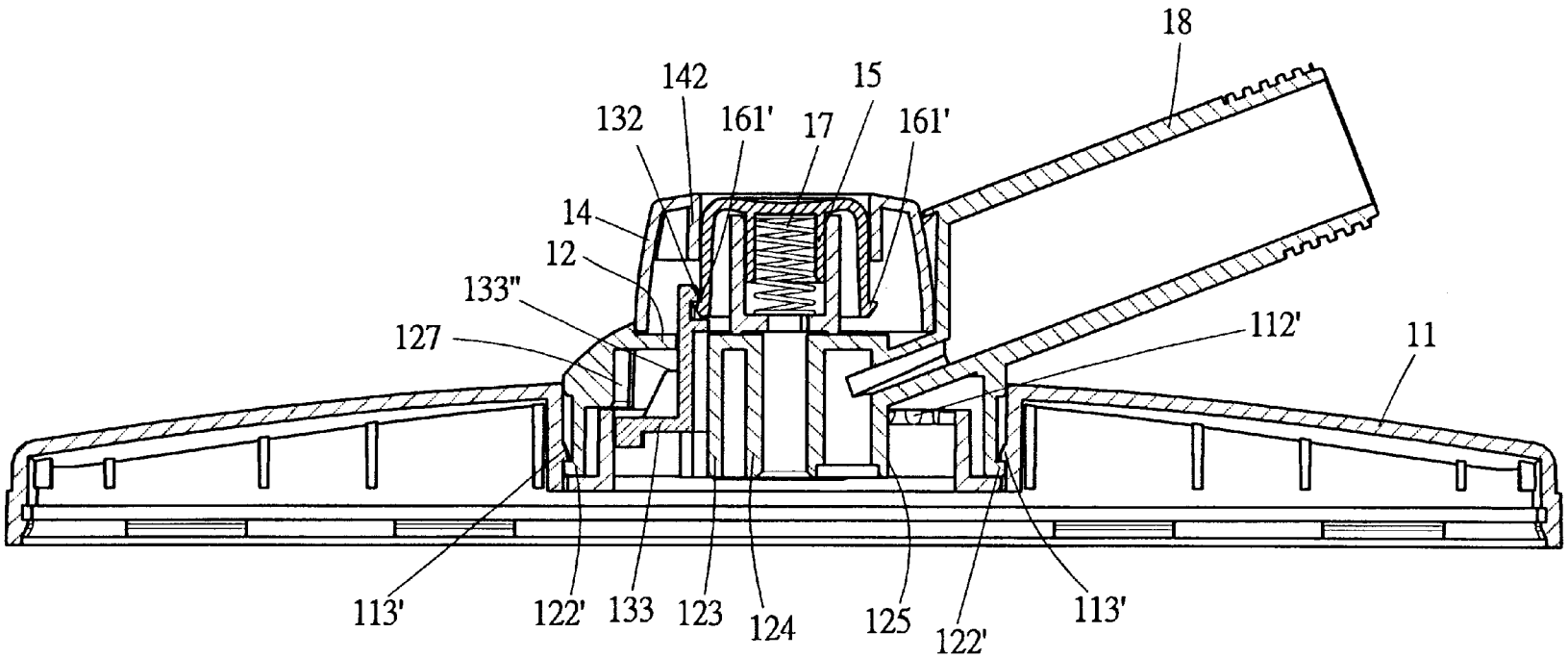
FIG. 10 is a sectional view taken along line A—A of FIG. 8, in which the press button is pressed.
Figure 11:
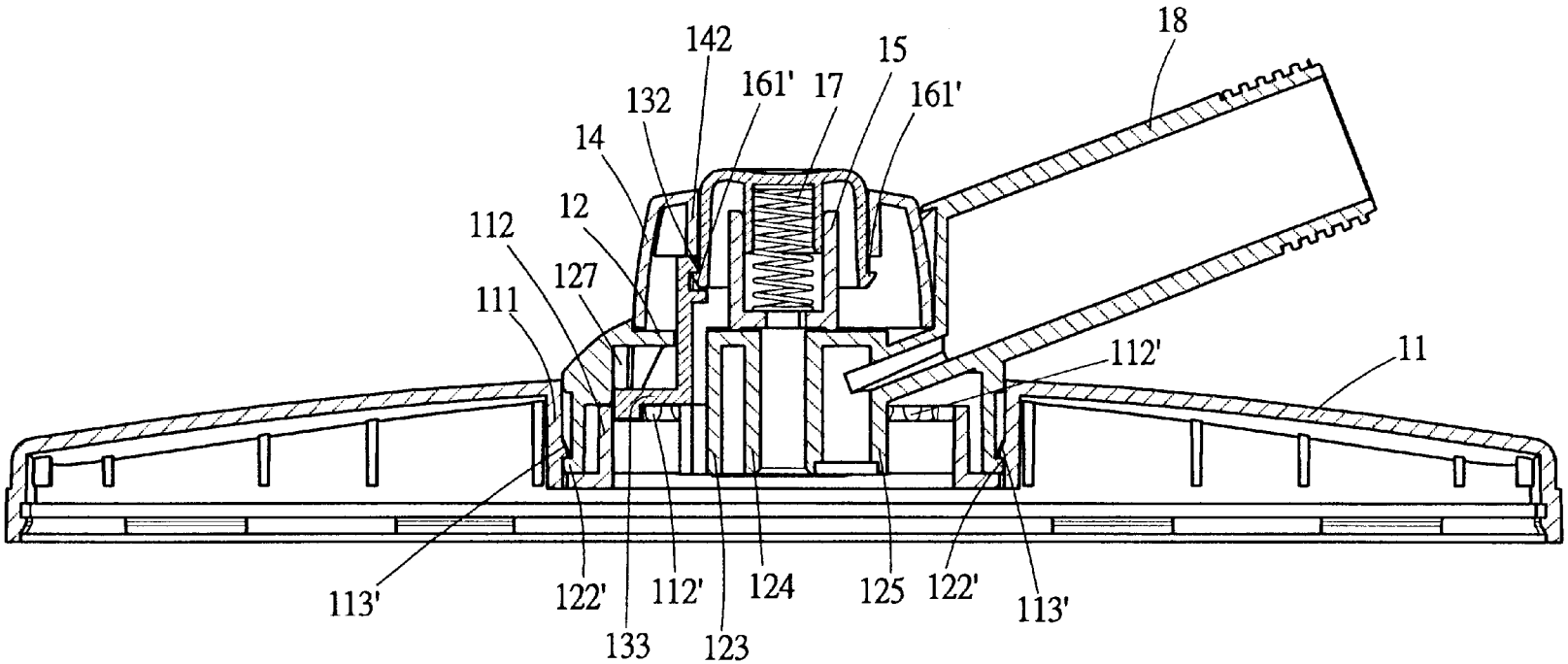
FIG. 11 is a sectional view taken along line A—A of FIG. 8, in which the press button is not pressed.

Please refer to FIGS. 1 to 11. The cleaning brush 1 with variable sprinkling pattern of the present invention includes a brush seat 11, a first base seat 12, a slide block 13, a rotary switch 14, a second base seat 15, a press button 16, a resilient member 17, a tube body 18, a sprinkling head 19 and a brush cover 20.

The brush seat 11 is a rectangular body having an opening facing downward. The middle of upper face is formed with concentric outer annular wall 111 and inner annular wall 112 having different diameters. The outer and inner annular walls 111, 112 define therebetween a circular first slide channel 113 in which a first slide channel connecting section 113' is disposed. The first slide channel connecting section 113' is a horizontal projection formed on the inner circumference of the outer wall 111. The inner circumference of the inner wall 112 is formed with several teeth 112' having equal height and annularly arranged at equal intervals.

The first base seat 12 is a circular body. An upper wall 121 upward extends from the circumference of the first base seat 12 and a lower wall 122 downward extends from the circumference of the first base seat 12 corresponding to the first slide channel 113. The circumference of lower end of the lower wall 122 is formed with a lower wall connecting section 122' which horizontally projects therefrom. The lower wall 122 is rotatably fitted in the first slide channel 113 with the first slide channel connecting section 113' is latched with the lower wall connecting section 122'.

The inner face of the first base seat 12 is formed with a downward extending hollow outer cylindrical body 123 and a hollow inner cylindrical body 124 which are concentric with the first base seat 12, while having different diameters. The upper end of the outer cylindrical body 123 is close, while the lower end thereof is open. Two ends of the inner cylindrical body 124 are both open.

A middle cylindrical body 125 has an interior space and an opening facing downward and is disposed between the outer and inner cylindrical bodies 123, 124.

A second slide channel 126 which is a straight channel body is disposed on outer face of the outer cylindrical body 123 in parallel to the axis thereof. The second slide channel 126 has a bottom face and two lateral faces. The top ends of the lateral faces are inward bent. The second slide channel 126 communicates with the outer face of the first base seat 12. The second slide channel 126 is spaced from the teeth 112' of the inner wall 112 by a predetermined distance.

The slide block 13 is slidably disposed in the second slide channel 126, including a slide section 131, a slide block latch section 132 and a slide block engaging section 133.

The slide section 131 is a bar body the left and right sides of which are outward bent to form a wing body slidably disposed in the second slide channel 126.

The slide block latch section 132 is a hook body bent from the upper end of the bar body and having a C-shaped cross-section. When the slide block 13 is up and down slided, the slide block latch section 132 is up and down moved on upper side of the first base seat 12.

The slide block engaging section 133 is formed by a block body extending from the lower end of the bar body to the inner wall 112. The rear end of the slide block engaging section 133 is formed with a projecting block 133' outward projecting between two teeth 112'. In addition, the middle of the front face of the bar body is formed with a projecting stop section 133". When the stop section 133" abuts against the inner face of the first base seat 12, the projecting block 133' is positioned between the two teeth 112'.

The rotary switch 14 is a hollow cylindrical body having two open ends. The lower end of the rotary switch 14 is concentrically rotatably fitted in the upper wall 121. The upper end of the rotary switch 14 is formed with a flange 141. A wall 142 downward extends from the inner circumference of the flange 141 by a certain height.

The second base seat 15 is a cylindrical body having an outer diameter smaller than the inner diameter of the flange 141. The second base seat 15 has an opening facing upward and is positioned in the inner circumference of the flange 141. At least one pair of beams 151 radially outward extend from outer circumference of the second base seat 15 to connect with the wall 142 of the flange 141. Accordingly, the second base seat 15 is concentrically disposed in the rotary switch 14, The lower end of the second base seat 15 is disposed with a rotary connecting section 152 formed by a polygonal perforation of the lower end of the second base seat 15.

The press button 16 is a circular plate body having an outer diameter corresponding to the inner diameter of the flange 141. Several engaging plates 161 downward extend from the circumference of the press button at intervals. The engaging plates 161 ride on the beams. The lower end of each engaging plate 161 is formed with a projecting latch section 161' vertically latching with the slide block latch section 132 without horizontally circumferentially latching with the same. Therefore, when the rotary switch 14 is rotated to drive the press button 14, one of the latch sections 161' is latched with the slide block latch section 132.

The resilient member 17 is disposed between the second base seat 15 and the press button 16.

The tube body 18 is connected with outer side of the upper wall 121 and the interior of the tube body communicates with the interior of the middle cylindrical body 125 to form a water passage.

The sprinkling head 19 is disposed in the brush seat 11 and positioned at the lower end of the middle cylindrical body 125, including a disc seat 191, a shaft rod 192 and several water outlets 193 with different shapes.

The upper face of the disc seat 191 abuts against the lower end of the middle cylindrical body 125.

The shaft rod 192 vertically upward extends from the center of the disc seat 191 and is rotatably fitted with the inner cylindrical body 124. The upper end is provided with a polygonal shaft rod connecting section 192' with a profile corresponding to the rotary connecting section 152 for engaging therewith.

The water outlets 193 are circumferentially arranged on the disc seat 191 at intervals. When the sprinkling head 19 is driven by the rotary switch 14, the water outlets 193 are respectively aimed at the lower opening of the middle cylindrical body 125.

The brush cover 20 is fixed at the opening of the brush seat 11 and formed with a perforation 201 corresponding to the sprinkling head 19. Brush hairs are densely disposed on lower face of the brush cover 20 around the perforation 201.

When cleaning a place, the rotary switch 14 is rotated to drivingly rotate the sprinkling head 19 to select the necessary sprinkling pattern. When encountering a dirty corner and the angle contained by the brush seat 11 and the tube body 18 needs to be changed, the press button 16 is pressed. At this time, one of the latch sections 161' downward pushes the slide block 13 and the projecting block 133' is disengaged from the two teeth 112', whereby the brush seat 11 can be rotated to a necessary direction. Then the press button 16 is released and the resilient member 17 upward pushes the press button 16. One of the latch section 161' upward pushes the slide block 13 and the projecting block 133' is positioned between the two teeth 112' to achieve a locating effect.

The cleaning brush 1 with variable sprinkling pattern of the present invention has the following advantages:

1. The sprinkling head is disposed at the brush head, whereby the cleaning brush has both functions of brushing and sprinkling. In addition, the sprinkling pattern is variable and the sprinkling head is close to the dirty place so that the cleaning brush can easily and effectively clean up the dirt.
2. The sprinkling head is disposed at the brush head so that it is unnecessary to replace the cleaning tool.
3. The brush hairs surround the sprinkling head, whereby when the sprinkling head is close to the dirty place for sprinkling off the dirt, the injected water beam will not splash back onto the user.

4. The switch for controlling the direction of the brush head and the switch for controlling the sprinkling head are integrally disposed so that the user can conveniently operate the switches and the freeness of the brush head will not be affected.

The resilient member 17 in this embodiment is a coil spring.

The present invention can further have a first locating channel 123' and at least one second locating channel 194.

The first locating channel 123' is disposed on the outer cylindrical body 123 for receiving therein a locating pin and a spring.

The second locating channel 194 is disposed on the upper face of the disc seat 191 corresponding to the first locating channel 123', whereby when the sprinkling head 19 is driven by the rotary switch 14, a locating effect is provided for the user to perceive.

The lower end of the middle cylindrical body 125 is formed with a depression in which a leakproof washer R for achieving a watertight state between the water outlets 193 and the middle cylindrical body 125.

A locking screw is disposed between the rotary connecting section 152 and the shaft rod connecting section 192'.

The present invention further includes a first base seat engaging section 127 formed by two parallel rectangular bodies downward extending from inner face of the first base seat 12. The first base seat engaging section 127 is opposite to the two teeth 112' and the second slide channel 126. The distance between the inner edges of the rectangular bodies is equal to the distance between the inner edges of the two teeth 112'. The extending length of the rectangular bodies will not exceed the upper edges of the teeth 112'. When the first base seat 12 via the lower wall 122 is rotated within the first slide channel 113, the lower edges of the two rectangular bodies are slided along the upper edges of the teeth 112'. When the projecting block 133' is positioned between the two teeth 112', the projecting block 133' is also positioned between the rectangular bodies. Therefore, after the present invention is rotated and located, the locating effect is enhanced.

In addition, the middle of outer face of the engaging plate 161 is formed with several projecting balancing stop sections 161". When the press button 16 is upward pushed by the resilient member 17 and the projecting block 133' is positioned between the teeth 112', the balancing stop sections 161" abut against the lower end of the wall 142 so that the latch section 161' is truly latched with the slide block latch section 132 in a balanced state.

The above embodiments are only used to illustrate the present invention, not intended to limit the scope thereof. Many modifications of the above embodiments can be made without departing from the spirit of the present invention.

What is claimed is:

1. A cleaning brush with a variable sprinkling pattern, comprising:

a brush seat which is a rectangular body having an opening facing downward, the middle of an upper face thereof being formed with a concentric outer wall and an inner annular wall having different diameters, the outer and inner walls defining therebetween a circular first slide channel in which a first slide channel connecting section is disposed, the inner circumference of the inner wall being formed with several teeth having equal height and annularly arranged at equal intervals, the first slide channel connecting section being a horizontal projection formed on the inner circumference of the outer wall;

a first base seat which is a circular body, an upper wall upward extending from the circumference of the first base seat and a lower wall downward extending from the circumference of the first base seat corresponding to the first slide channel, the circumference of the lower end of the lower wall being formed with a lower wall connecting section which horizontally projects therefrom, the lower wall being rotatably fitted in the first slide channel with the first slide channel connecting section latched with the lower wall connecting section, the inner face of the first base seat being formed with a downward extending hollow outer cylindrical body and a hollow inner cylindrical body which are concentric with the first base seat, while having different diameters, the upper end of the outer cylindrical body being close, while the lower end thereof being open, two ends of the inner cylindrical body being both open;

a middle cylindrical body having an interior space and an opening facing downward and being disposed between the outer and inner cylindrical bodies;

a second slide channel which is a straight channel body disposed on an outer face of the outer cylindrical body in parallel to the axis thereof, the second slide channel having a bottom face and two lateral faces, the top ends of the lateral faces being inward bent, the second slide channel communicating with the outer face of the first base seat, the second slide channel being spaced from the teeth of the inner wall by a predetermined distance;

a slide block slidably disposed in the second slide channel, including a slide section, a slide block latch section and a slide block engaging section, the slide section being a bar body the left and right sides of which are outward bent to form a wing body slidably disposed in the second slide channel, the slide block latch section being a hook body bent from the upper end of the bar body and having a C-shaped cross-section, whereby when the slide block is up and down slided, the slide block latch section is up and down moved on an upper side of the first base seat, the slide block engaging section being formed by a block body extending from the lower end of the bar body to the inner wall, the rear end of the slide block engaging section being formed with a projecting block outward projecting between two teeth, the middle of the front face of the bar body being formed with a projecting stop section, whereby when the stop section abuts against the inner face of the first base seat, the projecting block is positioned between the two teeth;

a rotary switch which is a hollow cylindrical body having two open ends, the lower end of the rotary switch being concentrically rotatably fitted in the upper wall, the upper end of the rotary switch being formed with a flange, a wall downward extending from the inner circumference of the flange by a certain height;

a second base seat which is a cylindrical body having an outer diameter smaller than the inner diameter of the flange, the second base seat having an opening facing upward and being positioned in the inner circumference of the flange, at least one pair of beams radially outward extending from an outer circumference of the second base seat to connect with the wall of the flange, whereby the second base seat is concentrically disposed in the rotary switch, the lower end of the second base seat being disposed with a rotary connecting section;

a press button which is a circular plate body having an outer diameter corresponding to the inner diameter of the flange, several engaging plates downward extending from the circumference of the press button at intervals, the engaging plates riding on the beams, the lower end of each engaging plate being formed with a projecting latch section vertically latching with the slide block latch section without horizontally circumferentially latching with the same, whereby when the rotary switch is rotated to drive the press button, one of the latch sections is latched with the slide block latch section;

a resilient member disposed between the second base seat and the press button;

a tube body connected with outer side of the upper wall and the interior of the tube body communicates with the interior of the middle cylindrical body to form a water passage;

a sprinkling head disposed in the brush seat and positioned at the lower end of the middle cylindrical body, including a disc seat, a shaft rod and several water outlets with different shapes, the upper face of the disc seat abutting against the lower end of the middle cylindrical body, the shaft rod vertically upward extending from the center of the disc seat and being rotatably fitted with the inner cylindrical body, the upper end being provided with a shaft rod connecting section for engaging with the rotary engaging section, the water outlets being circumferentially arranged on the disc seat at intervals, whereby when the sprinkling head is driven by the rotary switch, the water outlets are respectively aimed at the lower opening of the middle cylindrical body; and a brush cover fixed at the opening of the brush seat and formed with a perforation corresponding to the sprinkling head, brush hairs being densely disposed on lower face of the brush cover around the perforation.

2. Cleaning brush with variable sprinkling pattern as claimed in claim 1, further comprising a first base seat engaging section formed by two parallel rectangular bodies downward extending from inner face of the first base seat, the first base seat engaging section being opposite to the two teeth and the second slide channel, the distance between the inner edges of the rectangular bodies being equal to the distance between the inner edges of the two teeth, whereby the extending length of the rectangular bodies will not exceed the upper edges of the teeth and when the first base seat via the lower wall is rotated within the first slide channel, the lower edges of the two rectangular bodies are slided along the upper edges of the teeth and when the projecting block is positioned between the two teeth, the projecting block is also positioned between the rectangular bodies so as to achieve an enhanced locating effect.

3. Cleaning brush with variable sprinkling pattern as claimed in claim 1, further comprising a first locating channel and at least one second locating channel, the first locating channel being disposed on the outer cylindrical body for receiving therein a locating pin and a spring, the second locating channel being disposed on the upper face of the disc seat corresponding to the first locating channel, whereby when the sprinkling head is driven by the rotary switch, a locating effect is provided for the user to perceive.

4. Cleaning brush with variable sprinkling pattern as claimed in claim 1, wherein the lower end of the middle cylindrical body is formed with a depression in which a leakproof washer for achieving a watertight state between the water outlets and the middle cylindrical body.

5. Cleaning brush with variable sprinkling pattern as claimed in claim 1, wherein the resilient member is a coil spring.

6. Cleaning brush with variable sprinkling pattern as claimed in claim 1, wherein the middle of outer face of the engaging plate is formed with several projecting balancing stop sections abutting against the lower end of the wall.

7. Cleaning brush with variable sprinkling pattern as claimed in claim 1, wherein the rotary connecting section is formed by a polygonal perforation disposed at the lower end of the second base seat, the upper end of the shaft rod being provided with a polygonal shaft rod connecting section with a profile corresponding to the rotary connecting section.

8. Cleaning brush with variable sprinkling pattern as claimed in claim 1, wherein a locking screw is disposed between the rotary connecting section and the shaft rod connecting section.

* * * * *